US005201652A

United States Patent [19]

Kawamura et al.

[11] Patent Number: 5,201,652

[45] Date of Patent: Apr. 13, 1993

[54] METHOD OF COOLING CLINKER AND CLINKER COOLING APPARATUS

[75] Inventors: Youji Kawamura; Chiaki Sasaki; Hiuma Kaneko; Takeshi Omi, all of Tokyo, Japan

[73] Assignee: Onoda Cement Co., Ltd., Japan

[21] Appl. No.: 720,910

[22] Filed: Jun. 25, 1991

[51] Int. Cl.[5] ..... F27D 15/02

[52] U.S. Cl. ..... 432/78; 432/14

[58] Field of Search ..... 432/14, 77, 78, 80

[56] References Cited

U.S. PATENT DOCUMENTS

| | | | |
|---|---|---|---|
| 2,879,983 | 3/1959 | Sylvest | 432/14 |
| 3,089,688 | 5/1963 | Ostberg | 432/77 |
| 3,304,619 | 2/1967 | Futer | 432/77 |
| 3,671,027 | 6/1972 | Frans | 432/14 |
| 3,782,888 | 1/1974 | Cnare | 432/18 |
| 3,887,326 | 6/1975 | Townley | 432/14 |
| 3,910,755 | 10/1975 | Syska | 432/14 |
| 4,078,882 | 3/1978 | Houd | 432/14 |
| 4,340,359 | 7/1982 | Struckmann | 432/14 |

*Primary Examiner*—A. Michael Chambers

[57] ABSTRACT

After a clinker sintered in a kiln is fluidized and mixed in a fluidized mixing and cooling zone provided before a grate cooling zone, the clinker is supplied to the following grate cooling zone and is cooled therein. The cooling air for fluidizing, mixing and cooling the clinker is supplied by successively switching and controlling the injection of the high pressure cooling air from the rows of the high pressure nozzles at the side walls towards the central rows in the fluidized mixing and cooling zone.

7 Claims, 7 Drawing Sheets

METHOD OF COOLING CLINKER AND CLINKER COOLING APPARATUS

BACKGROUND OF THE INVENTION

The present invention relates to a method of cooling by air or other gas, hot cement clinker, lime and the like that is burned or sintered by a cement burning device such as a rotary kiln, as well as a clinker cooling apparatus.

Normally, cement clinker sintered by a cement burning apparatus such as a rotary kiln is cooled by air or other gas flowing upwardly from below a grate through a layer of clinker formed from clinker falling on a grate-type cooling apparatus under high temperature conditions of about 1,300° C. In view of thermal economy, it is desirable to recover as much of the heat retained in the hot clinker fallen on the cooling apparatus as possible and to obtain as high a temperature exhaust gas as possible, because there are frequent cases where a part of the exhaust gas from such cooling apparatus is used in the burning apparatus as secondary air. Thus, the clinker layer formed in the cooling apparatus must be made into a distributed and uniformally thick layer.

However, since the clinker particle distribution rayers from particles finer than 1 mm to large lumps of more than 100 mm, and further since the clinker is discharged from a limited portion of the rotary kiln, it piles up on the grate to form a small hill, so that the thickness and particle sizes of the clinker layer are uneven or sometimes resulting in variations in particle size, temperature and amount of clinker from the rotary kiln. Thus, for the above mentioned reasons, the resistance to the cooling air differs according to time or position, resulting in uneven cooling to cause reductions in exhaust gas temperature and the phenomenon of raised clinker temperatures at the outlet of the cooling apparatus. Also, the thickness of the clinker layer at both ends of the clinker layer, that is, the thickness of the clinker layer at both ends of the clinker layer widthwise in the cooling apparatus is thinner than the thickness of the central portion thereof, and fine particles are condensed to cause the upward and downward mixing of the clinker layer fluidized by the cooling air, so that such disadvantageous as reductions of the exhaust gas temperature in the upper portion of the clinker layer are caused.

The apparatus is generally operated so that thickness of the clinker layer is within the range of about 300–700 mm, although it is desirable that the layer thickness be within 1,000–2,000 mm in view of heat recovery. However, in this event, troubles occur such as delays in cooling the upper portion of layer to cause sintering between the clinker particles, making movement of the clinker layer in the longitudinal direction difficult, and thus it is necessary that the apparatus be operated with a clinker layer thickness of about 300–700 mm.

SUMMARY OF THE INVENTION

Therefore, it is an object of the invention in order to resolve the problems of uneven airflow resistance in the clinker layer and the generation of sintering when there is a thick clinker layer in the prior art to provide a method and apparatus for cooling the clinker by mixing the clinker under fluidizing conditions in a fludizing zone for simultaneously mixing and cooling the clinker disposed befor a grate type cooling apparatus for cooling the clinker sintered in a kiln, and substantialy cooling the clinker in the following grate type apparatus.

In accordance with the present invention, a method of cooling clinker is presented in which a clinker sintered in a kiln is successively fluidized and mixed and is then cooled by an injection of high pressure cooling air from rows of high pressure nozzles on a stationary hearth in a fluidized mixing and cooling zone, the high pressure nozzles on the stationary hearth being provided in a plurality of rows arranged to run parallel to the direction of travel of the clinker, the cooled clinker is transported to a grate cooling zone following the fluidized mixing and cooling zone and is further cooled by an injection of low pressure cooling air in the grate cooling zone.

Furthermore, in accordance with the present invention, a clinker cooling apparatus is presented in which in a grate-type cooling apparatus for cooling a clinker sintered in a kiln, a plurality of high pressure nozzles for injecting high pressure cooling air are provided in a plurality of rows arranged to run parallei to a direction of travel of the clinker at a fluidized mixing and cooling zone provided before a grate cooling zone, where the injections of the high pressure cooling air from the high pressure nozzles are successively switched and controlled from the rows of the high pressure nozzles at the side wall of the fluidized mixing and cooling zone towards the center row of high pressure nozzles.

Also, in accordance with the present invention, the injections of the high pressure cooling air from said nozzles are detected by air pressure detectors provided on high pressure cooling air conduits, so that when there is no injection the volume of air flow can be adjusted by the adjusting valves.

Other objects, features and advantages of the present invention will be become apparent from the following description taken in connection with the accompanying drawings.

BRIEF DESCRIPTION OF THE DRAWINGS

The invention will be explained in conjunction with a plurality of illustrative embodiments shown in the accompanying drawings, in which.

DESCRIPTION OF THE PREFERRED EMBODIMENTS

Figure 1:
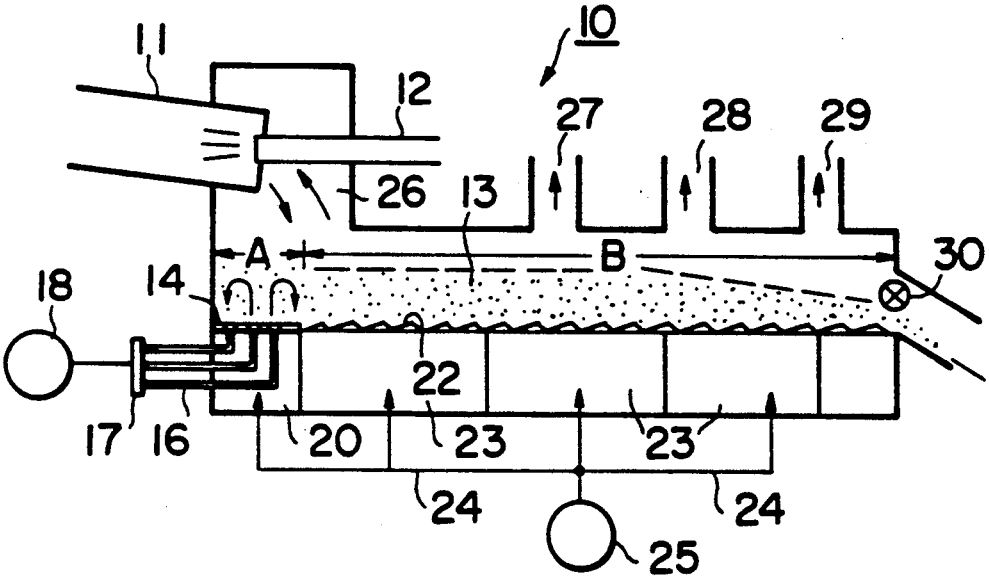
FIG. 1 shows a schematic view of a first embodiment of a clinker cooling apparatus for carrying out the method of cooling a clinker according to the present invention.
Figure 2:
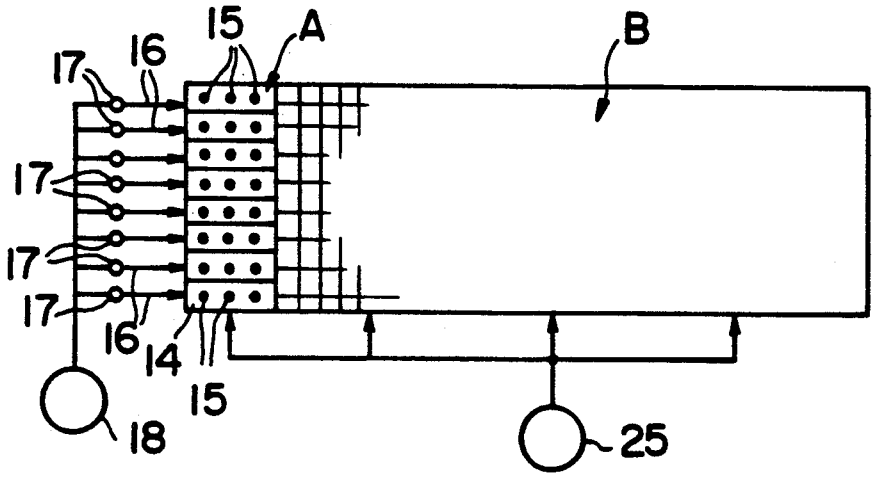
FIG. 2 shows a plan view of the fluidized mixing and cooling zone and the grate cooling zone of the clinker cooling apparatus in FIG. 1.

In FIGS. 1 and 2 there is shown a first embodiment of a clinker cooling apparatus for carrying out the method of cooling a clinker of the present invention, wherein as shown in the drawings of the present invention a clinker cooling apparatus 10 is provided to connect with a clinker outlet side of a cement burning apparatus such as a rotary kiln 11 provided with a burner 12 for the kiln, the characterizing portion of the present invention, a fluidized mixing and cooling zone A, is formed at a clinker discharge portion, that is, a clinker supply portion of the rotary kiln 11 and a so-called grate cooling zone B is formed after this fluidized mixing and cooling zone A. In this first embodiment shown, in the fluidized mixing and cooling zone A of the clinker cooling apparatus 10 a stationary hearth 14 is provided with a plurality of high pressure nozzles 15. These high pressure nozzles 15 are divided into a plurality of rows arranged in the direction of travel of the clinker, and are respectively connected with the headers 17 through the conduits 16, each of the headers 17 having a multi-way valve and a solenoid valve such as a changing means associated in each of the rows and is connected with a high pressure blower 18 for supplying cooling air. Furthermore, it is preferable to provide a cooling chamber 20 below the hearth 14 of the fluidized mixing and cooling zone A for supplying the high pressure cooling air. Also, it is preferable to provide a plurality of apertures for injecting the low pressure cooling air on the hearth 14 of the fluidized mixing and cooling zone A except for the high pressure nozzles 15.

In a grate cooling zone B continuing from the fluidized mixing and cooling zone A of the clinker cooling apparatus 10, a reciprocating grate 22 is provided for cooling and carrying the thick clinker layer to communicate with a cooling chamber 23 under the grate 22 capable to supply cooling air through conduits 24 from a low pressure fan 25. The cooling chamber 23 below the grate 22 in the grate cooling zone B can be divided into a number of chambers, if necessary.

Thus, in the grate cooling zone B, the hot clinker 13 moving on the reciprocating grate 22 is cooled by the cooling air supplied into the cooling chambers 23 below the grate 22 by the lower pressure fan 25, the cooling air thus being heated by heat-exchange with the hot clinker 13, the hot exhaust gas from the fluidized mixing and cooling zone A and a part of the upstream side of the grate cooling zone B is used as secondary air 26 for the kiln and the other gas is used in accordance with successive heat reduction as bleed air 27 for an additive combustion furnace and bleed air 28 for a water supply heater, and finally the lowest thermal value exhaust gas is discharged through a dust collector to the atmosphere as dust collector exhaust gas, but the usage of the recovered exhaust gas is not limited with this embodiment. The completely cooled clinker 13 is carried through a crusher 30 for crushing the larger lumps to the next process by a conveyer for example.

The high pressure nozzles 15 for injecting the high pressure cooling air and the apertures for injecting the low pressure cooling air provided in the fluidized mixing and cooling zone A of the clinker cooling apparatus 10 are controlled and operated as follows:

For example, as shown in FIG. 2 being the plan view for the fluidized mixing and cooling zone A of the clinker cooling apparatus 10, a plurality of high pressure nozzles 15 are divided into a plurality of rows arranged in the clinker travel direction. If such rows of high pressure nozzles 15 from top to bottom in the figures as first, second . . . and eighth rows, the injections of the high pressure cooling air from the high pressure nozzles 15 first take place at the outer most rows near the side walls, i.e. at the first and second rows and the seventh and eighth rows. After a certain time the injections of high pressure cooling air successively move to the second and third rows and the sixth and seventh rows, and then to the third and fourth rows and the fifth and sixth rows. During the injections of the high pressure cooling air, injections of low pressure cooling air from apertures in the hearth 14 take place preferably together with the injections of the high pressure cooling air at the high pressure nozzles 15 to an extent to prevent the burning of the grates and the falling of lumps of clinker.

In this way, although it is preferable to successively switch the injections of the high pressure cooling air from the first two rows closest to each side wall inwards towards the central rows one row at a time, i.e. from the first and second rows to the second and third rows, the injections of the high pressure cooling air can of course be switched from the single outmost rows of the high pressure nozzles 15 at both sides towards the central row, i.e. from the first to the second to the third, etc.

Figure 3:
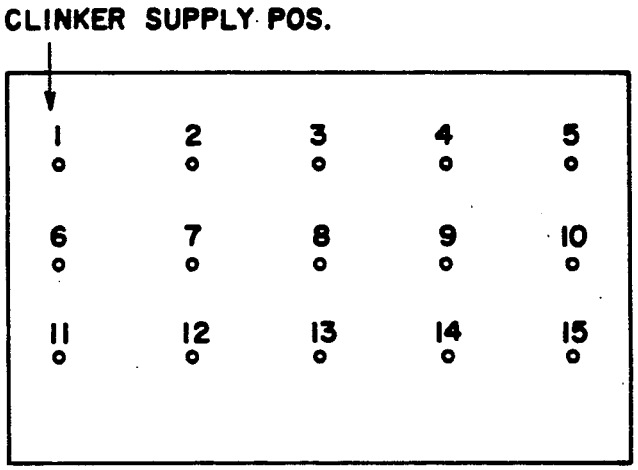
FIG. 3 shows a plan view for the arrangement of the high pressure nozzles in the half portion of the fluidized mixing and cooling zone of the clinker cooling apparatus.
Figure 4:
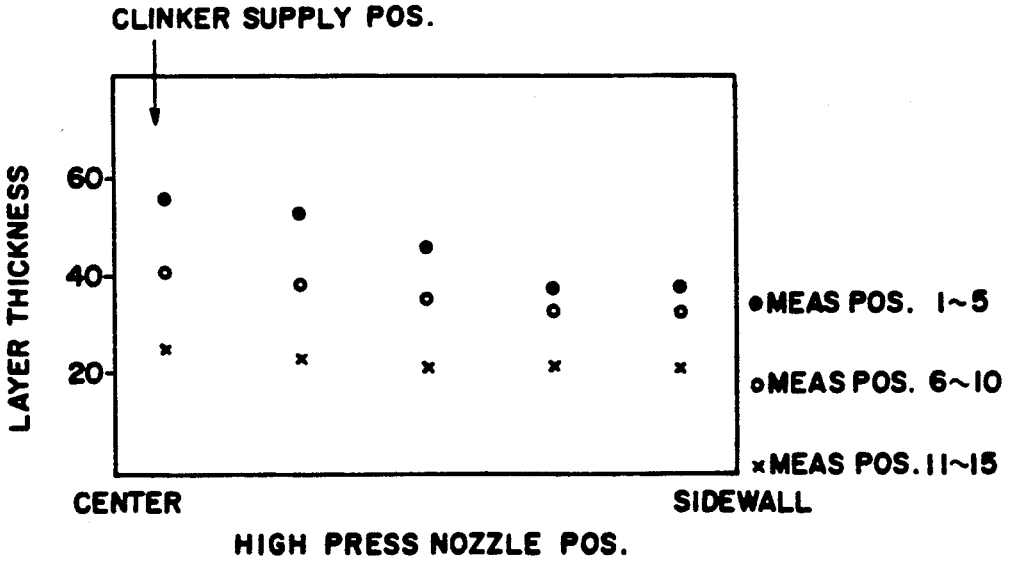
FIG. 4, FIG. 5 and FIG. 6 show respectively the relationship of the high pressure nozzle position and the clinker layer thickness in the cases of non-injection of the high pressure cooling air, of the switching of the injection of the high pressure cooling air from the side wall and of the switching of the injection of the high pressure cooling air from the center.
Figure 5:
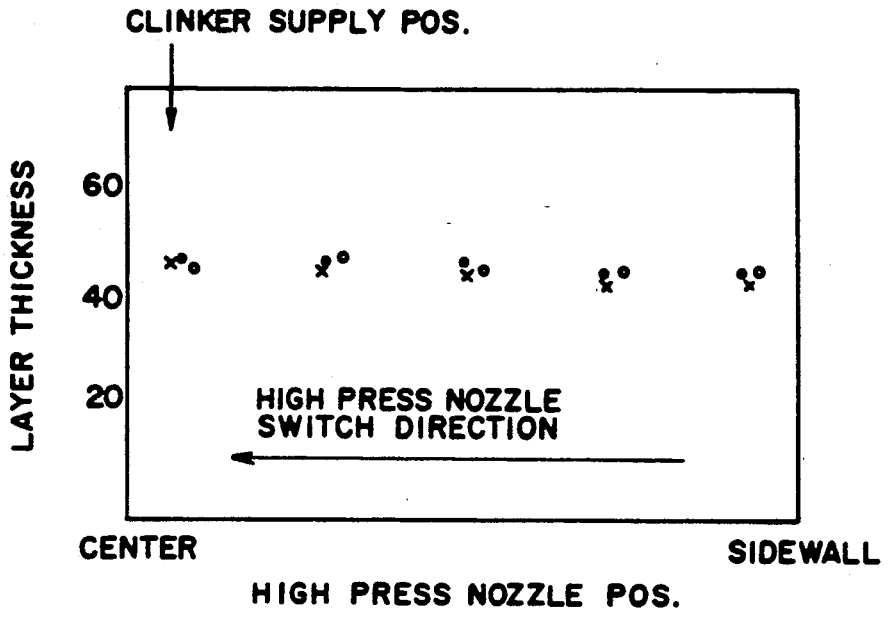
Figure 6:
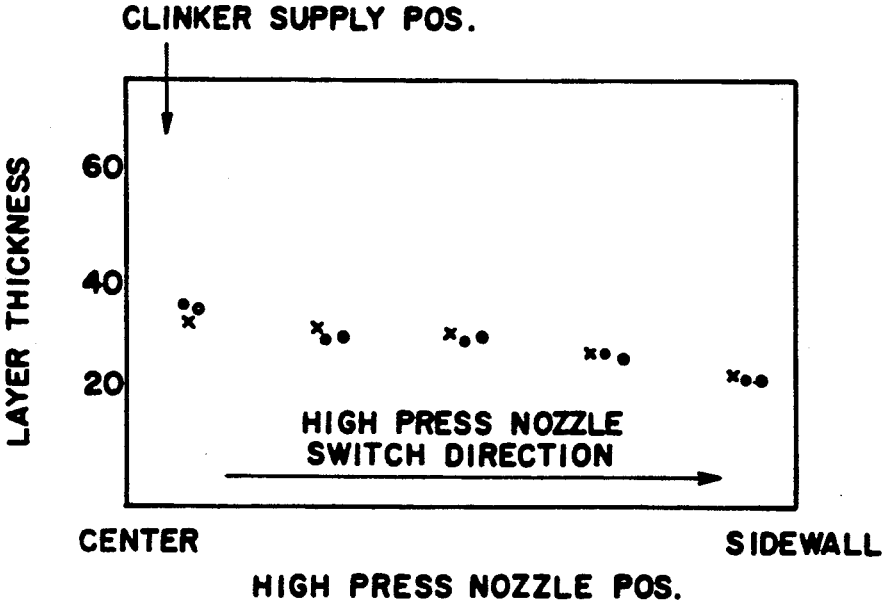

Next, results of experiments regarding the relationship of the high pressure nozzles and the thickness of the clinker layer where ten rows of three high pressure nozzles each were arranged in the fluidized mixing and cooling zone in accordance with the method of cooling the clinker for the present invention. FIG. 3 shows a plan view for half of the arrangement of high pressure nozzles from the either side to the central portion. FIGS. 4, 5 and 6 show respectively the relationships of the clinker layer thickness to the high pressure nozzles when there was no injection of high pressure cooling air (FIG. 4), when there was switching of the injections of the high pressure cooling air from the side wall sides towards the center (FIG. 5) and when the switch of the injection of the high pressure cooling air was from the center towards the side wall sides (FIG. 6).

Firstly, as shown in FIG. 4, when there is no injection of high pressure cooling air, that is, when there is no fluidization with just the blowing of low pressure cooling air, the clinker layer is thick in the vicinity of the central portion and moreover the thickness near where the clinker is supplied is most thick, with the thickness gradually thinning towards the side walls and further the thickness in the direction of travel of the clinker is thinning out, so that the thickness of the layer is uneven.

As shown in FIG. 5, when the injection of high pressure cooling air is taken together with the switching of the high pressure cooling air from the rows at the outer sides of the high pressure nozzles to the central rows thereof, the thickness of the clinker layer at any portion of the high pressure nozzles is evened out, and the surface of the clinker layer is substantially flat to faciliate the fluidized mixing of the clinker, to achieve a satisfactory mixing rate of the clinker particles. Furthermore, when the switching of the high pressure nozzles is begun from the clinker supply position, that is, the central area, as shown in FIG. 6 the clinker layer at the clinker supply side, i.e. the central area forms a small hill etc. to cause un-eveness in the clinker layer.

By carrying out the switching of the high pressure nozzles in this manner from the rows near the side walls towards the central row the thickness of the clinker layer become not only uniform but smooth, the degree of mixing of the clinker particles is not only sufficient but favorable without the generation of clinker particle segregation, and the amounts of high pressure cooling air flow and the power used are reduced to be favorable economic. Also, the interval of pressure nozzles switching is preferable about 3~20 seconds.

In this way, following the cooling at the fluidized mixing cooling zone A in the method of cooling the clinker for the present invention, the still hot clinker 13 moving towards the discharge direction on the reciprocating grates 22 in the next grate cooling zone B is cooled by injections of low pressure cooling air from the cooling chamber 23 below the grate 22 by the low pressure fan 25. Thus, the cooling air is heat-exchanged with the cooling clinker and is therefor heated to be used respectively assecondary air 26 for the kiln, bleed air 27 for an additive combustion furnace and bleed air 28 to a supply water heater, and is finally discharged to the atmosphere as electric dust collector exhaust 29.

Figure 7:
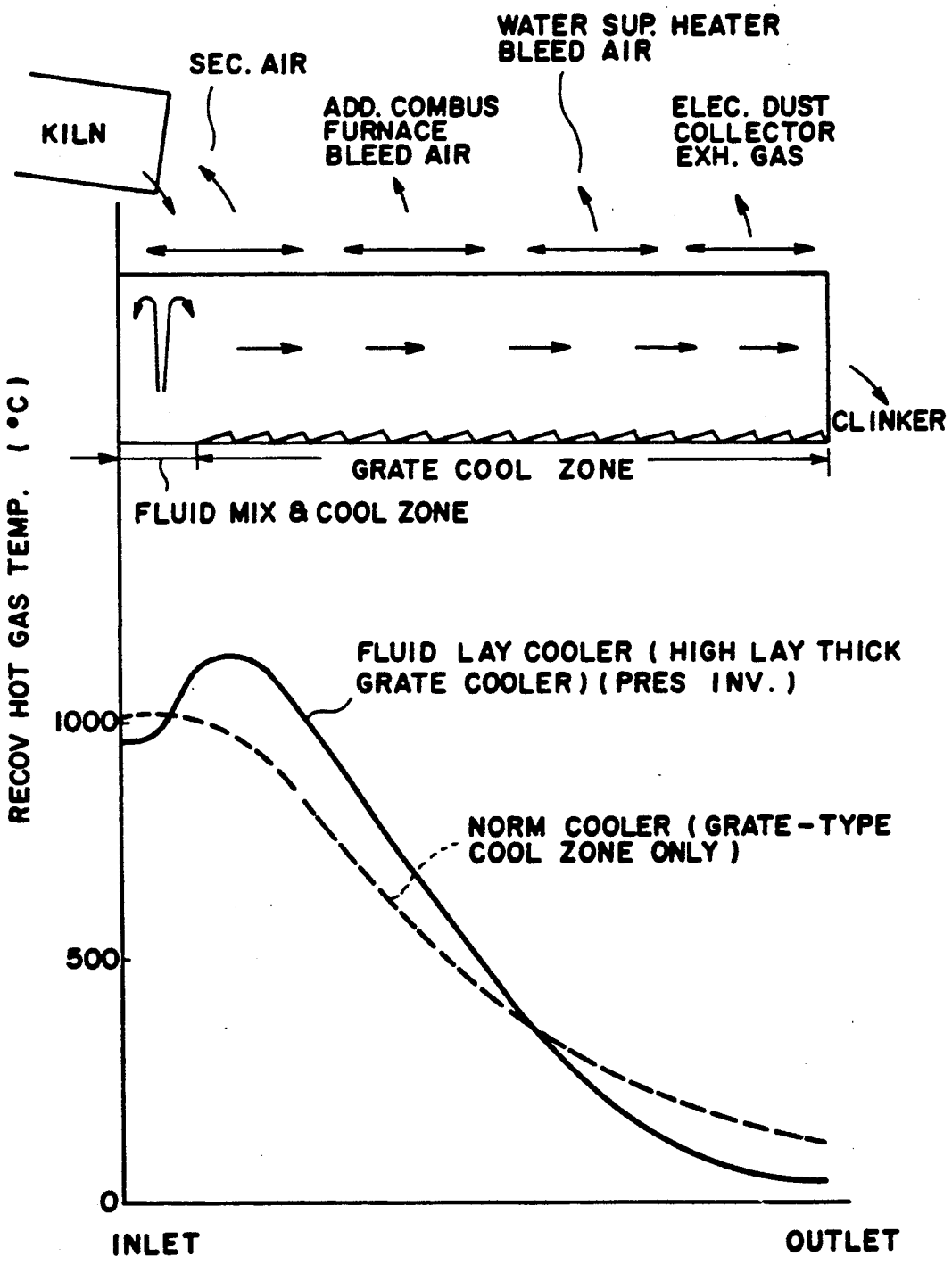
FIG. 7 shows a graph of the change of the clinker temperatures in the fluidized mixing and cooling zone and the grate cooling zone of the clinker cooling apparatus.

In FIG. 7, the temperatures of the clinker in the fluidized mixing and cooling zone A and the grate zone B with the method of cooling the clinker of the present invention are shown in which, as can be understood from this drawing, the amount of heat recovery is increased, the used heat capacity is reduced by about 3.8%, the amount of heat recovery in the water supply heater is increased by about 17%, and the clinker temperature at the outlet of the clinker cooling apparatus is cooled to less than 100° C. Thus, for a given clinker temperature at the outlet of the clinker cooling apparatus, the amount of air used can be greatly reduced, and for a given amount of air not only can the temperature of the clinker be reduced further, but this makes it possible to also reduce size of the clinker cooling apparatus accordingly.

Figure 8:
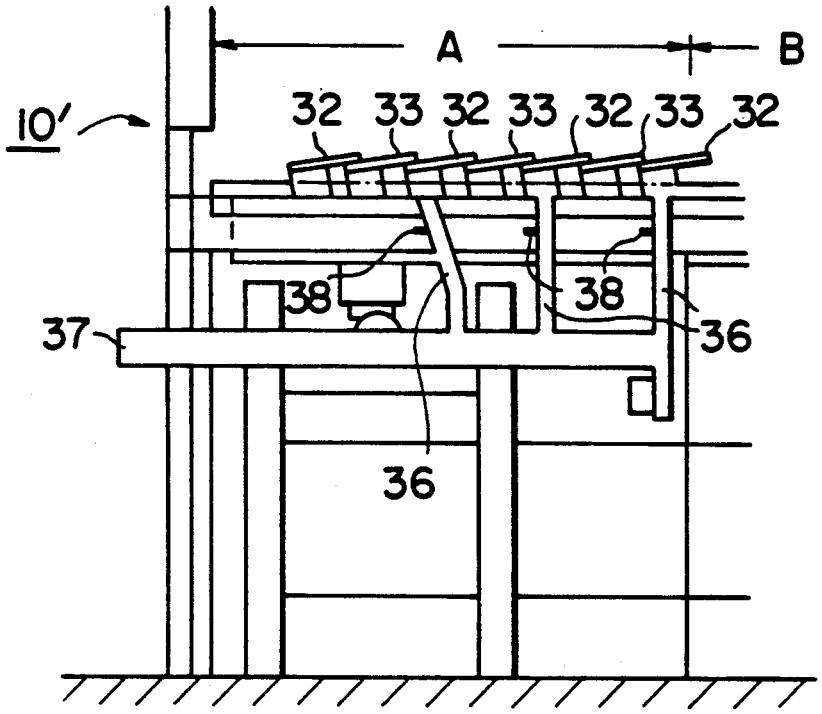
FIG. 8, FIG. 9 and FIG. 10 show a side view, and end view and a plan view for a second embodiment of the clinker cooling apparatus for carrying out the method of cooling the clinker of the present invention.
Figure 9:
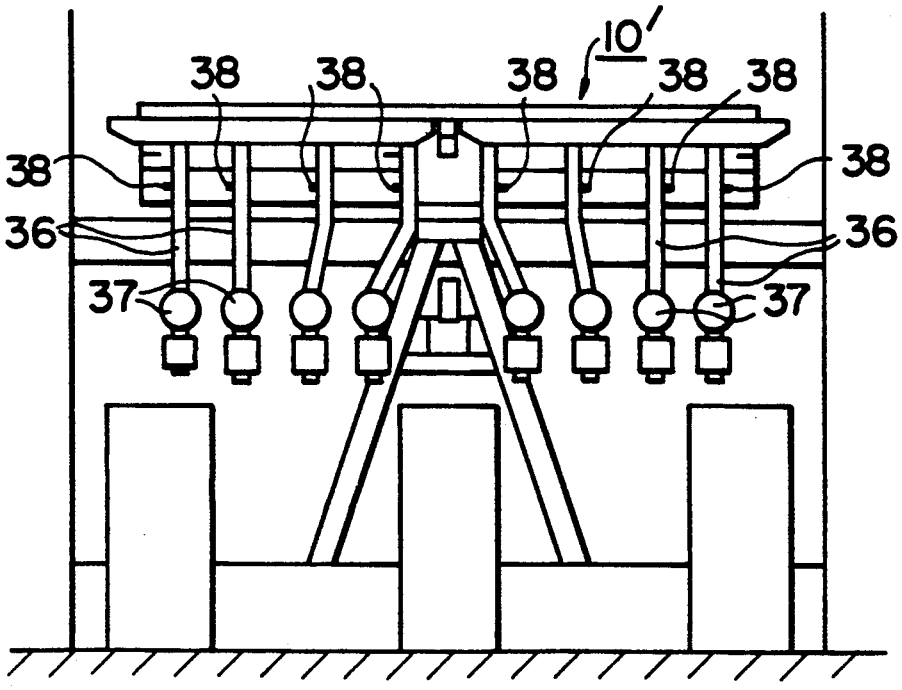
Figure 10:
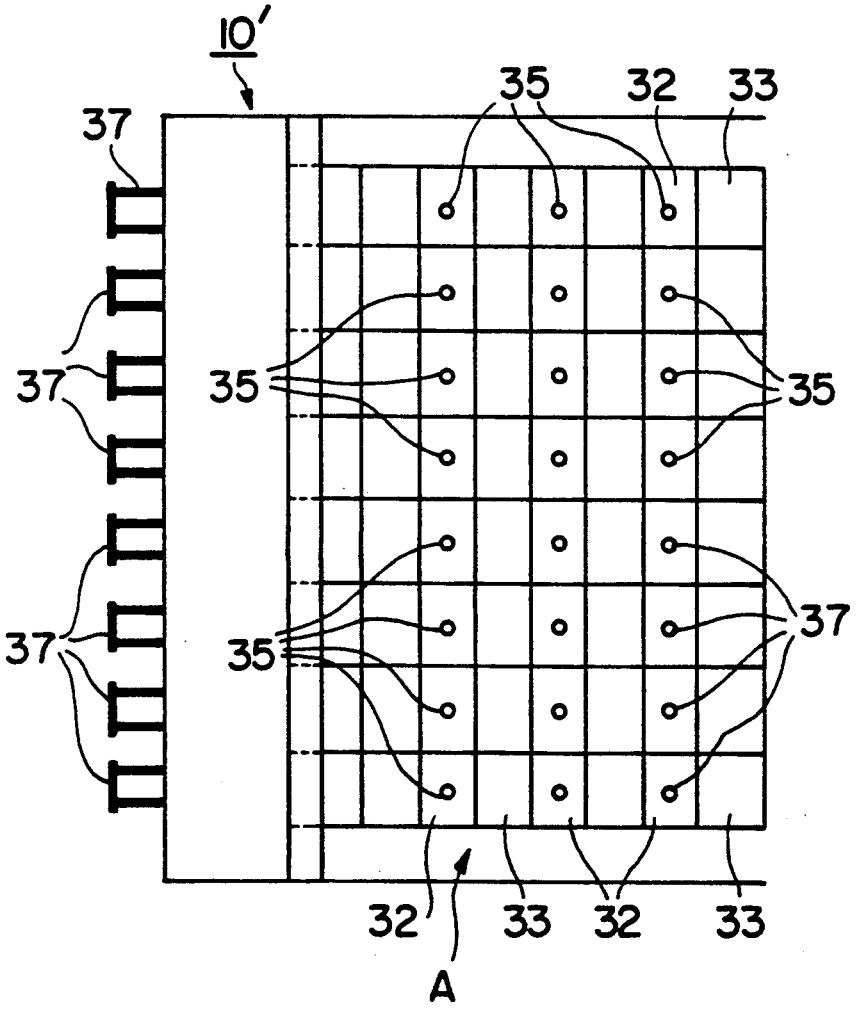

In FIGS. 8 to 10, another embodiment for carrying out a method of cooling clinker of the present invention is shown which differs from the previous embodiment in that the fluidized mixing and cooling zone A and the grate cooling zone B are constituted from tationary grates 32 and movable grates 33. The stationary grates 32 and the movable grates 33 are alternatelly provided, the high pressure nozzles 35 are provided in the stationary grates 32 in the fluidized mixing and cooling zone A to be divided to rows in direction of clinker tavel as in the previous embodiment, with the high pressure nozzle 35 being connected through the conduits 36 with the headers 37 in each of the rows. The switching of these high pressure nozzles 35 is carried out to successively switch from the rows of the high pressure nozzles 35 at the side wall sides towards the high pressure nozzles at the center portion in the same manner as in the previous embodiment.

Figure 11:
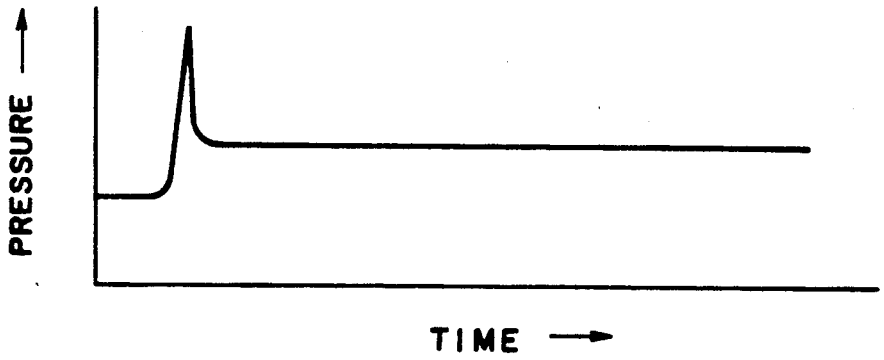
FIG. 11 and FIG. 12 show the changes of the injected air pressure detected by the air pressure detectors.
Figure 12:
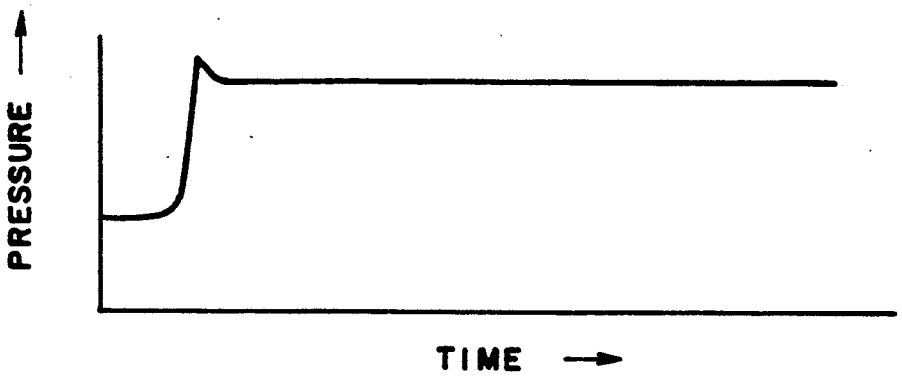

Air pressure detectors 38 are provided in the conduits 36 for the high pressure air to detect the injection of the high pressure air from the high pressure nozzles 35, so that the amount of high pressure air can be adjusted by the adjusting valves 39. Detection of the injection of the high pressure air from the high pressure nozzles 35 can be made according to the changes of the pressure detected by the air pressure detectors as shown in FIGS. 11 and 12. In FIG. 11, on event of the injection of the high pressure from the high pressure nozzles 35 is shown in which the pressure P is increased, and after the arrival of the peak the pressure is decreased and thereafter maintained at a substantially constant pressure. In FIG. 12, the event of non-injection of the high pressure air from the high pressure nozzles 35 is shown in which the pressure P is increased, and after arrival at the peak the pressure is maintained at a substantially constant pressure.

In this embodiment, as compared with the previous embodiment, not only are can smaller improvements of existing grate-type coolers sufficient to result in cheaper equipment costs, but also the positive transport by the reciprocating grates of large lumps of clinker in the fluidized mixing zone A becomes possible.

In this way, in accordance with the method and apparatus for cooling clinker of the present invention, hot clinker from a rotary kiln is fluidized with uniform layer thickness in the fluidized mixing and cooling zone and rapidly mixed and cooled by high pressure cooling air under the successive switching of the injection of the high pressure cooling air from the rows of high pressure nozzles at the side wall sides inwards towards the central rows, and at the same time achieve excellent clinker mixing and cooling effects. Also, in regard to the clinker particle size, the charges in the amount or temperature accompanying the charges in the fluidizing conditions can be accomodated by the adjustment of the flow rate adjusting valves in the conduits of the high pressure nozzles. In this manner, the clinker is effectively mixed and cooled in the fluidized mixing and cooling zone, so that the clinker layer in the fluidized mixing and cooling zone has a uniform particle size and thickness, and uniform venting resistance. Furthermore, as the clinker in the fluidized mixing and cooling zone is sufficiently cooled at temperatures of less than 1200° C., there is no fear of sintering, the thickness of the clinker layer in the grate cooling zone can be kept thick, and the clinker moving on the grates can be appropriately cooled. Further, the cooling air heat-exchanged with the hot clinker can be effectively heat-recovered and used as secondary air for a kiln, bleed air for an additive combustion furnace or bleed air for a water supply heater. In particular, by successively switching and controlling the rows of high pressure nozzles in the fluidized mixing and cooling zone from the rows near the side wall inwards towards the central rows, can effectively achive a fluidized mixing and cooling of the clinker to have a uniform layer thickness without segregation of clinker particles, to bring about effects such as the amount of high pressure cooling air and the power used can be economically reduced, recovered heat capacity is can be incleased, the life of the grate can be extended by reducing the temperature of the clinker directly on the grate and the quality of the cement can be increased.

What is claimed is:

1. A method of cooling a hot clinker sintered in a kiln comprising the steps of, fluidizing and cooling said clinker by an injection of high pressure cooling air from a row of high pressure nozzles on a stationary hearth in a fluidized mixing and cooling zone, said high pressure nozzles on said stationary hearth being provided in a plurality of rows arranged to run parallel to the direction of travel of the clinker, transporting said cooled clinker to a grate cooling zone following said fluidized mixing and cooling zone, and further cooling said cooled clinker by an injection of low pressure cooling air in said grate cooling zone; the successively switching of the rows of high pressure nozzles is carried out from the rows of high pressure nozzles on the side wall sides of the fluidized mixing and cooling zone to the rows of high pressure nozzles in the central portion thereof.

2. A method as claimed in claim 1, wherein the injection of high pressure cooling air is successively switched among the rows of high pressure nozzles provided on the stationary hearth in the fluidized mixing and cooling zone.

3. A method as claimed in claim 1, wherein the high pressure cooling air is supplied from the high pressure nozzles provided on the stationary hearth connected with a high pressure cooling air chamber.

4. A grate-type cooling apparatus for cooling a clinker sintered in a kiln, characterized in that a plurality of high pressure nozzles for injecting high pressure cooling air are provided in a plurality of rows arranged to run parallel to a direction of travel of the clinker at a fluidized mixing and cooling zone provided before a grate cooling zone, where the injections of the high pressure cooling air from said high pressure nozzles are succesively switched and controlled from the rows of the high pressure nozzles at the side wall of the fluidized mixing and cooling zone towards the center row of the high pressure nozzles.

5. An apparatus as claimed in claim 4, wherein a stationary hearth is provided in the fluidized mixing and cooling zone, said hearth being communicated with a high pressure cooling air chamber for supplying high pressure cooling air thereto.

6. An apparatus as claimed in claim 4 or 5, wherein at least one air discharge port for supplying a portion of the cooling air is provided on a side wall of the fluidized mixing and cooling zone.

7. A grate-type cooling apparatus for cooling a clinker sintered in a kiln, characterized in that a plurality of high pressure nozzles for injecting high pressure cooling air provided in a plurality of rows arranged to run parallel to a direction of travel of the clinker at a fluidized mixing and cooling zone provided before a grate cooling zone, where the injections of the high pressure cooling air from said high pressure nozzles are succesively switched from the rows of the high pressure nozzles at the side walls of the fluidized mixing and cooling zone towards the center row thereof, and the injection of the high pressure cooling air from said nozzles are detected by air pressure detectors provided on high pressure cooling air conduits for controlling the switching of the injection of the high pressure cooling air from the high pressure nozzles and of the injection value of the high pressure cooling air.

* * * * *